US007670400B2

(12) United States Patent
Reynolds et al.

(10) Patent No.: US 7,670,400 B2
(45) Date of Patent: Mar. 2, 2010

(54) MOTOR MOUNT ASSEMBLY FOR AN AIR CLEANER

(75) Inventors: Charles W. Reynolds, Long Beach, MS (US); Owen T. Bourgeois, Pass Christian, MS (US); Christopher M. Paterson, Biloxi, MS (US)

(73) Assignee: Oreck Holdings, LLC, Cheyenne, WY (US)

( * ) Notice: Subject to any disclaimer, the term of this patent is extended or adjusted under 35 U.S.C. 154(b) by 814 days.

(21) Appl. No.: 11/350,713

(22) Filed: Feb. 9, 2006

(65) Prior Publication Data

US 2007/0183910 A1 Aug. 9, 2007

(51) Int. Cl.
*B01D 45/21* (2006.01)
*B01D 33/00* (2006.01)

(52) U.S. Cl. ..... 55/473; 55/400; 55/471; 55/472; 55/501; 55/503; 55/467; 55/385.2; 416/146 R; 454/230; 310/91; 415/213.1; 417/363; 417/361; 417/424.1; 417/423.15; 417/423.14

(58) Field of Classification Search ..... 55/400, 55/471, 472, 473, 501, 503, 467, 385.2; 416/146 R; 454/230; 310/91; 415/213.1; 417/363, 361, 417/424.1, 423.15, 423.14
See application file for complete search history.

(56) References Cited

U.S. PATENT DOCUMENTS

| | | | | |
|---|---|---|---|---|
| 4,043,708 | A | 8/1977 | Greenfield | |
| 4,173,458 | A * | 11/1979 | Stiles | 55/405 |
| 5,188,644 | A * | 2/1993 | Landy | 95/268 |
| 5,215,438 | A | 6/1993 | Chou et al. | |
| 5,855,634 | A * | 1/1999 | Berfield | 55/472 |
| 6,110,248 | A * | 8/2000 | Liu | 55/490 |
| 6,118,645 | A | 9/2000 | Partridge | |
| 6,156,088 | A | 12/2000 | Cardarelli | |
| 6,264,712 | B1 * | 7/2001 | Decker | 55/456 |
| 6,315,525 | B1 | 11/2001 | Webb | |
| 6,357,247 | B1 | 3/2002 | Moretti | |
| 6,372,005 | B1 * | 4/2002 | Fiacco | 55/400 |
| 6,514,304 | B2 * | 2/2003 | Fiacco | 55/400 |
| 6,616,722 | B1 * | 9/2003 | Cartellone | 55/459.3 |
| 6,663,698 | B2 * | 12/2003 | Mishin et al. | 96/142 |
| 6,689,315 | B2 * | 2/2004 | Linker et al. | 422/45 |
| 6,695,580 | B2 * | 2/2004 | Finkenbinder | 415/208.3 |
| 6,712,889 | B2 * | 3/2004 | Pillion et al. | 96/418 |
| 2001/0029728 | A1 | 10/2001 | Massey et al. | |
| 2003/0074871 | A1 | 4/2003 | Huang | |
| 2004/0154126 | A1 * | 8/2004 | Hansen et al. | 15/353 |
| 2005/0123398 | A1 * | 6/2005 | Tam et al. | 415/211.2 |
| 2005/0125939 | A1 * | 6/2005 | Hansen et al. | 15/353 |

OTHER PUBLICATIONS

Definition of Motor—http://www.merriam-webster.com/dictionary/motor; downloaded on Mar. 9, 2009.

* cited by examiner

*Primary Examiner*—Duane Smith
*Assistant Examiner*—Minh-Chau T Pham
(74) *Attorney, Agent, or Firm*—Winston & Strawn LLP

(57) ABSTRACT

A motor mount assembly for an air cleaner is provided according to an embodiment of the invention. The motor mount assembly includes a motor ring adapted for receiving a motor, a mount ring adapted to be received in the air cleaner, and a plurality of mounting vanes extending between the motor ring and the mount ring. A mounting vane of the plurality of mounting vanes includes a proximal end and a distal end. The distal end is affixed to the motor ring and the proximal end is affixed to the mount ring.

31 Claims, 8 Drawing Sheets

MOTOR MOUNT ASSEMBLY FOR AN AIR CLEANER

TECHNICAL FIELD

The present invention relates to an air cleaner, and more particularly, to a motor mount assembly for an air cleaner.

BACKGROUND OF THE INVENTION

Air cleaners and purifiers are widely used for removing foreign substances from the air. The foreign substances can include pollen, dander, smoke, pollutants, dust, etc. In addition, an air cleaner can be used to circulate room air. An air cleaner can be used in many settings, including at home, in offices, workrooms, etc.

In one prior art air cleaner, a typical air cleaner includes an air moving device that generates an airflow, such as an electric motor and impeller. The air moving device is located in an air duct that also includes an air cleaning device(s). As a result, the airflow traveling in the air duct passes through filter elements and/or other air cleaning devices in order to remove dirt and debris from the airflow.

A typical electrical motor used in an air cleaner comprises a cylindrical body including a circumferential surface and two ends. A typical prior art motor mount can comprise a plate or bracket that is attached to an end of the motor by threaded fasteners. Alternatively, a prior art motor mount can clamp to or be part of the motor itself, including arms that extend radially from the motor, for example.

SUMMARY OF THE INVENTION

A motor mount assembly for an air cleaner is provided according to an embodiment of the invention. The motor mount assembly comprises a motor ring adapted for receiving a motor, a mount ring adapted to be received in the air cleaner, and a plurality of mounting vanes extending between the motor ring and the mount ring. A mounting vane of the plurality of mounting vanes comprises a proximal end and a distal end. The distal end is affixed to the motor ring and the proximal end is affixed to the mount ring.

A motor mount assembly for an air cleaner is provided according to an embodiment of the invention. The motor mount assembly comprises an airflow shaper including a substantially cylindrical, hollow end and a plurality of cut-outs formed in the end. The motor mount assembly further comprises a motor mount comprising a motor ring adapted for receiving a motor, a mount ring adapted to be received in the air cleaner, and a plurality of mounting vanes extending between the motor ring and the mount ring. A mounting vane of the plurality of mounting vanes comprises a proximal end and a distal end. The distal end is affixed to the motor ring and the proximal end is affixed to the mount ring.

A method of installing a motor in an air cleaner is provided according to an embodiment of the invention. The method comprises providing an airflow shaper including a substantially cylindrical, hollow end, a plurality of cut-outs formed in the end, and a plurality of shaper fastener apertures formed in the end. The method further comprises inserting the motor into the airflow shaper and inserting a plurality of fastener bosses of the motor into the plurality of cut-outs of the airflow shaper. The method further comprises sliding a motor mount over the motor and into contact with the airflow shaper. The motor mount comprises a motor ring adapted for receiving a motor, a mount ring adapted to be received in the air cleaner, and a plurality of mounting vanes extending between the motor ring and the mount ring. A mounting vane of the plurality of mounting vanes comprises a proximal end and a distal end. The distal end is affixed to the motor ring and the proximal end is affixed to the mount ring. The method further comprises inserting a plurality of motor ring fasteners through a corresponding plurality of motor ring fastener apertures of the motor ring and into engagement with the plurality of shaper fastener apertures of the airflow shaper. The method further comprises engaging a plurality of motor fasteners with the plurality of fastener bosses of the motor. The plurality of motor fasteners clamp one or both of the motor mount and the airflow shaper to the motor.

BRIEF DESCRIPTION OF THE DRAWINGS

The same reference number represents the same element on all drawings. It should be noted that the drawings are not necessarily to scale.

DETAILED DESCRIPTION OF THE INVENTION

FIGS. 1-8 and the following descriptions depict specific embodiments to teach those skilled in the art how to make and use the best mode of the invention. For the purpose of teaching inventive principles, some conventional aspects have been simplified or omitted. Those skilled in the art will appreciate variations from these embodiments that fall within the scope of the invention. Those skilled in the art will also appreciate that the features described below can be combined in various ways to form multiple variations of the invention. As a result, the invention is not limited to the specific embodiments described below, but only by the claims and their equivalents.

Figure 1:
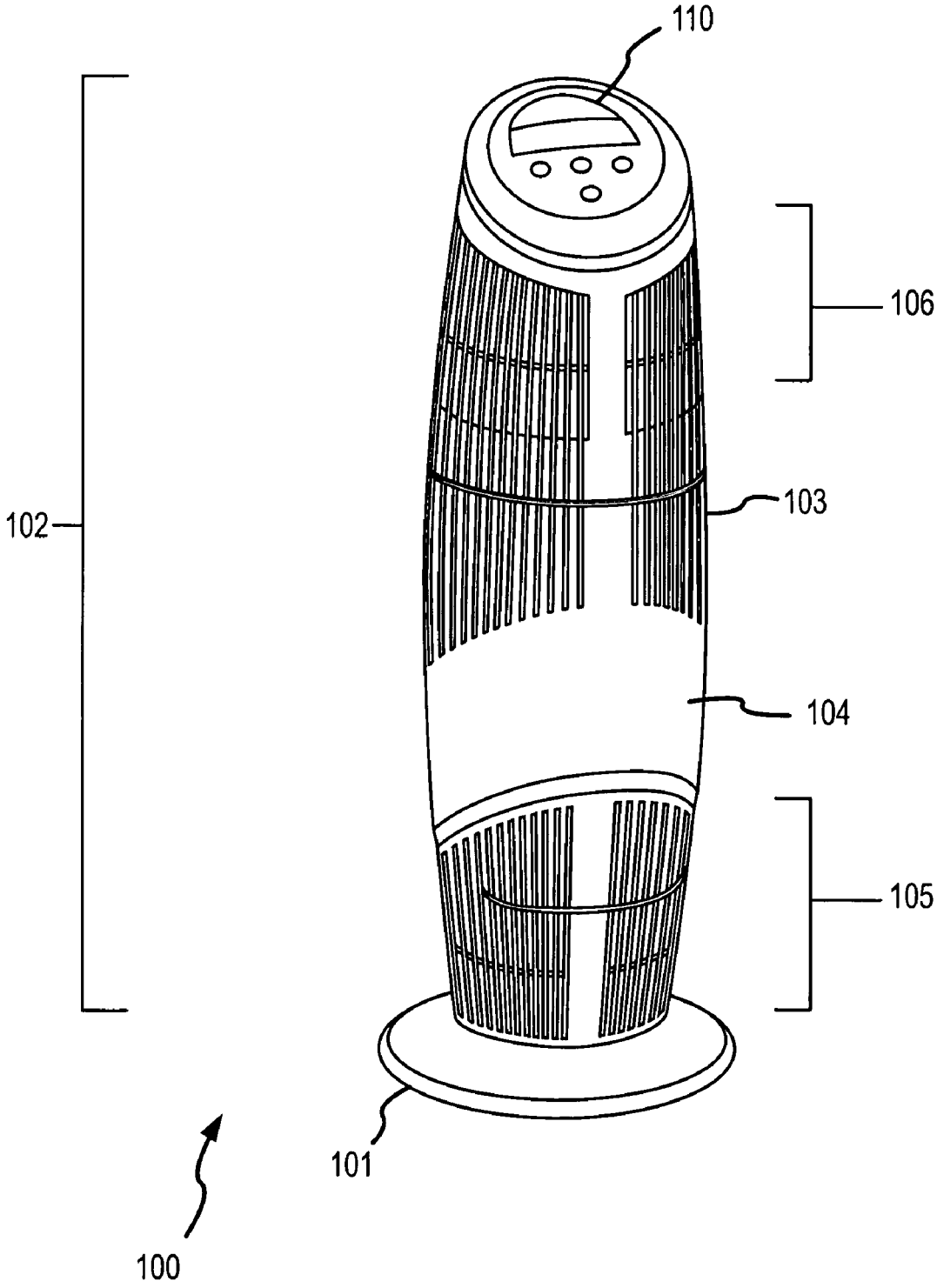
FIG. 1 shows a tower air cleaner according to an embodiment of the invention.

FIG. 1 shows a tower air cleaner 100 according to an embodiment of the invention. The tower air cleaner 100 includes a base portion 101 and a tower portion 102. The tower portion 102 can be generally vertically positioned and elongate in shape. In one embodiment, the tower portion 102 can be substantially cylindrical in shape. The tower portion 102 includes a shell 103, one or more doors 104, and a control panel 110. The tower portion 102 further includes an air inlet 105 and an air outlet 106. Air is drawn in through the air inlet 105, is cleaned inside the tower portion 102, and the cleaned air is exhausted from the air outlet 106. However, it should be understood that the air cleaner 100 can comprise other shapes, configurations, and designs, and the tower configuration is shown merely for illustration.

The air inlet 105 is shown as being at the lower end of the tower portion 102. However, it should be understood that alternatively the relative positions of the air inlet 105 and the air outlet 106 could be interchanged.

Figure 2:
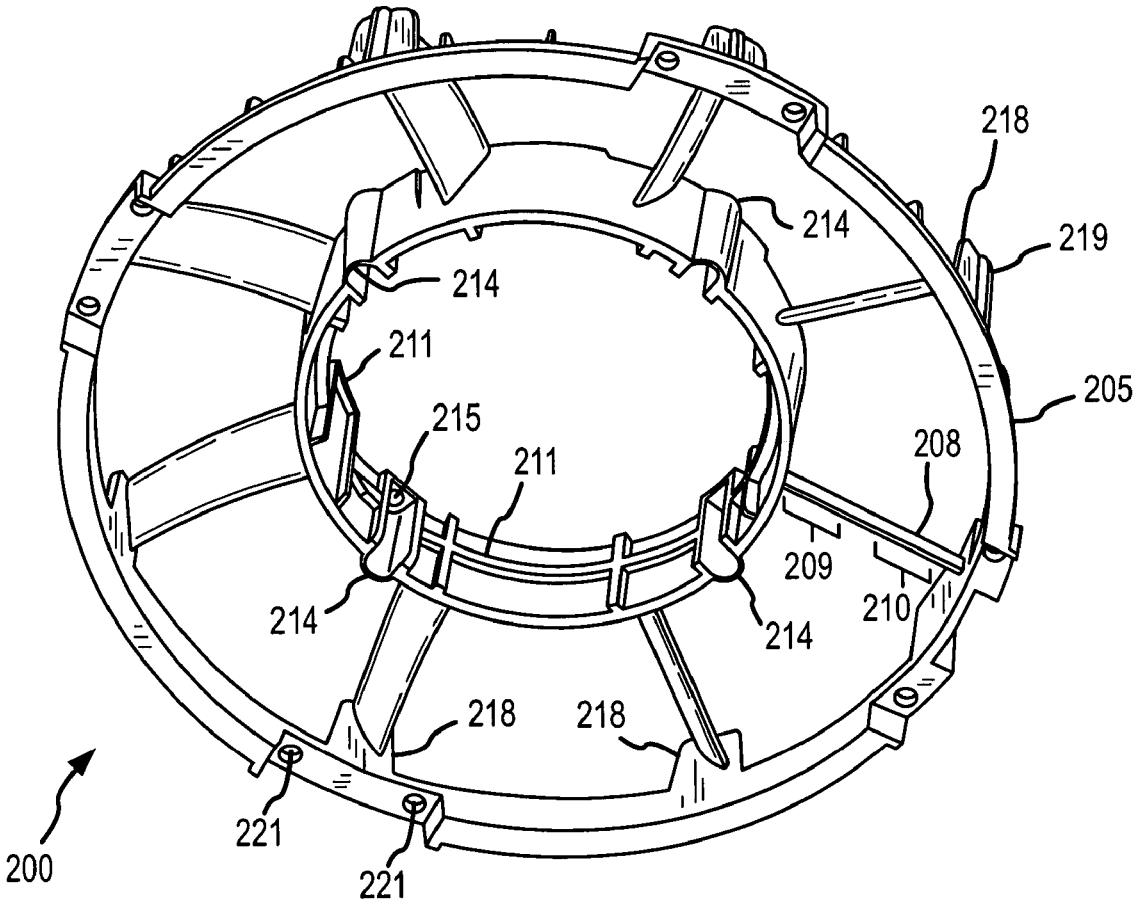
FIG. 2 shows at least a portion of a motor mount assembly according to an embodiment of the invention.

FIG. 2 shows at least a portion of a motor mount assembly 200 according to an embodiment of the invention. The figure shows a motor mount 202 according to an embodiment of the invention. The motor mount 202 includes a motor ring 204, a mount ring 205, and a plurality of mounting vanes 208 extending between the motor ring 204 and the mount ring 205. The motor ring 204 holds a motor 230 substantially coaxially centered in the motor mount 202 (see FIG. 3). The motor ring 204 includes a plurality of fastener clearance troughs 214 and corresponding motor ring fastener apertures 215. The motor ring fastener apertures 215 can receive motor ring fasteners (not shown) that are used to join the motor ring 204 to an airflow shaper 250 (see FIG. 6).

The motor ring 204 further includes a plurality of projecting members 211 that extend from an inner surface of the motor ring 204. The projecting members 211 can contact the motor 230 and can exert a frictional force on the motor 230. The projecting members 211 can additionally strengthen the motor ring 204.

The mounting vanes 208 extend between the motor ring 204 and the mount ring 205 and serve to support the motor 230. A mounting vane 208 includes a proximal end 210 and a distal end 209. The distal end 209 is affixed to the motor ring 204 and the proximal end 210 is affixed to the mounting ring 205. It should be understood that the mounting vanes 208 can be joined to the motor ring 204 and the mount ring 205, or alternatively the three portions can be formed as an integral unit.

In the embodiment shown, eight mounting vanes 208 are employed. However, the number of mounting vanes 220 can be varied.

The mounting vanes 208 can have an aerodynamic cross-sectional shape. This can include rounded leading edges and can include tapered trailing edges. For example, the mounting vanes 208 can have an airfoil cross-sectional shape. In addition, the mounting vanes 208 can include an arch (better seen in FIG. 3), wherein the mount ring 205 is at a lower level than the motor ring 204 when seen from a substantially horizontal position. Furthermore, the mounting vanes 208 can include an angle that conforms to a rotation of the airflow. The rotation can exist due to the rotation of an impeller 233, and angling the mounting vanes 208 substantially in alignment with the rotating airflow reduces drag generated by the mounting vanes 208.

The mount ring 205 is configured to be assembled to a frame or chassis (not shown) of the air cleaner 100. Therefore, the mount ring 205 includes a plurality of mount ring fastener apertures 221. In addition, the mount ring 205 includes a plurality of extensions 218 that receive ends of the mounting vanes 208. An extension 218 can include a rib 219. The rib 219 provides additional strength to the extension 218. In addition, the rib 219 can fit into a corresponding feature in the frame and can serve an alignment purpose.

Figure 3:
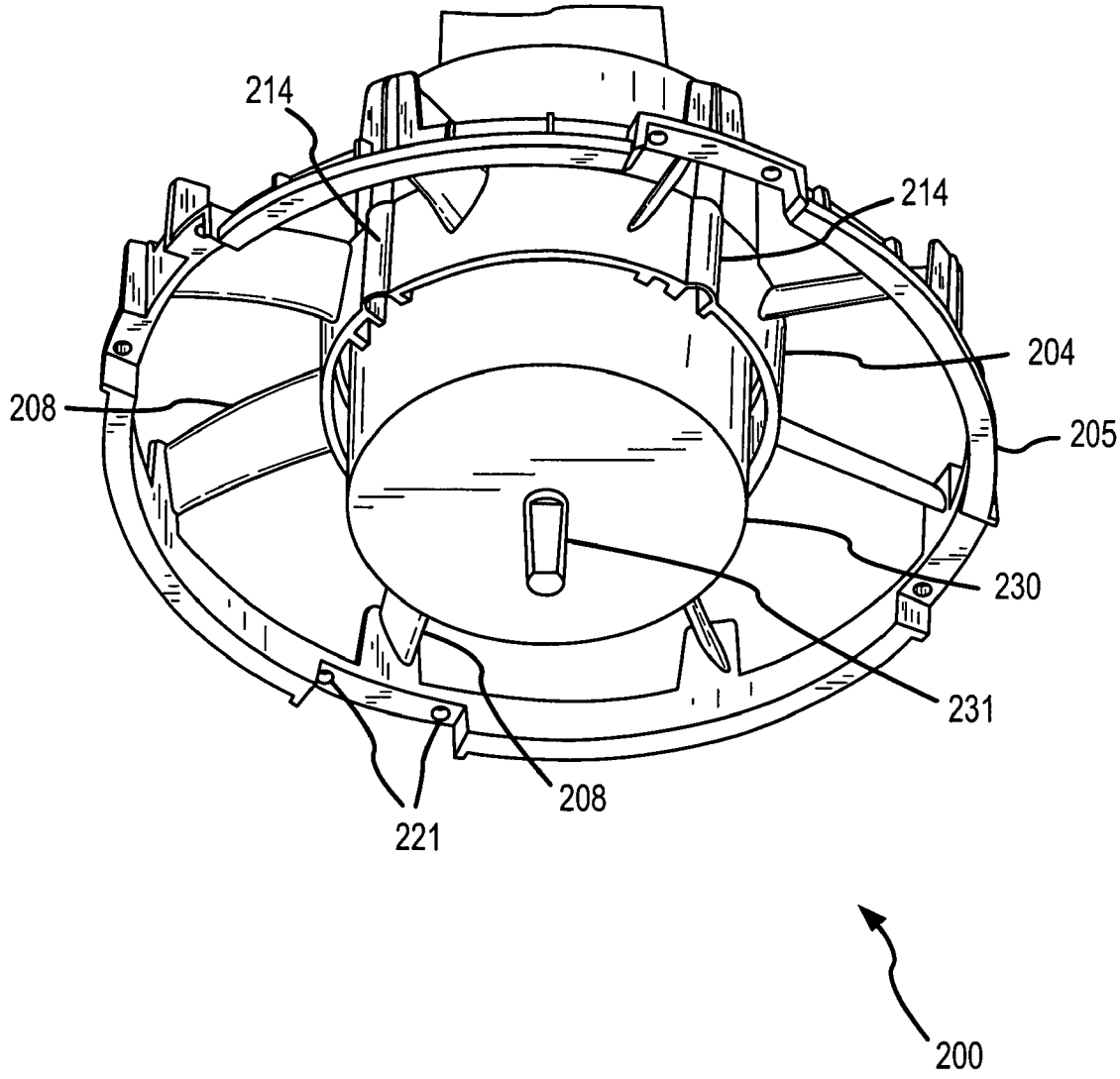
FIG. 3 shows a motor in position in the motor ring of the motor mount according to an embodiment of the invention.

FIG. 3 shows a motor 230 in position in the motor ring 204 of the motor mount 202 according to an embodiment of the invention. This figure additionally shows the motor shaft 231. The motor 230 can be snugly or loosely received in the motor ring 204 and can contact the projecting members 211. The motor ring 204 can further contact a plurality of fastener bosses 234 of the motor 230 (see FIG. 5, for example).

Figure 4:
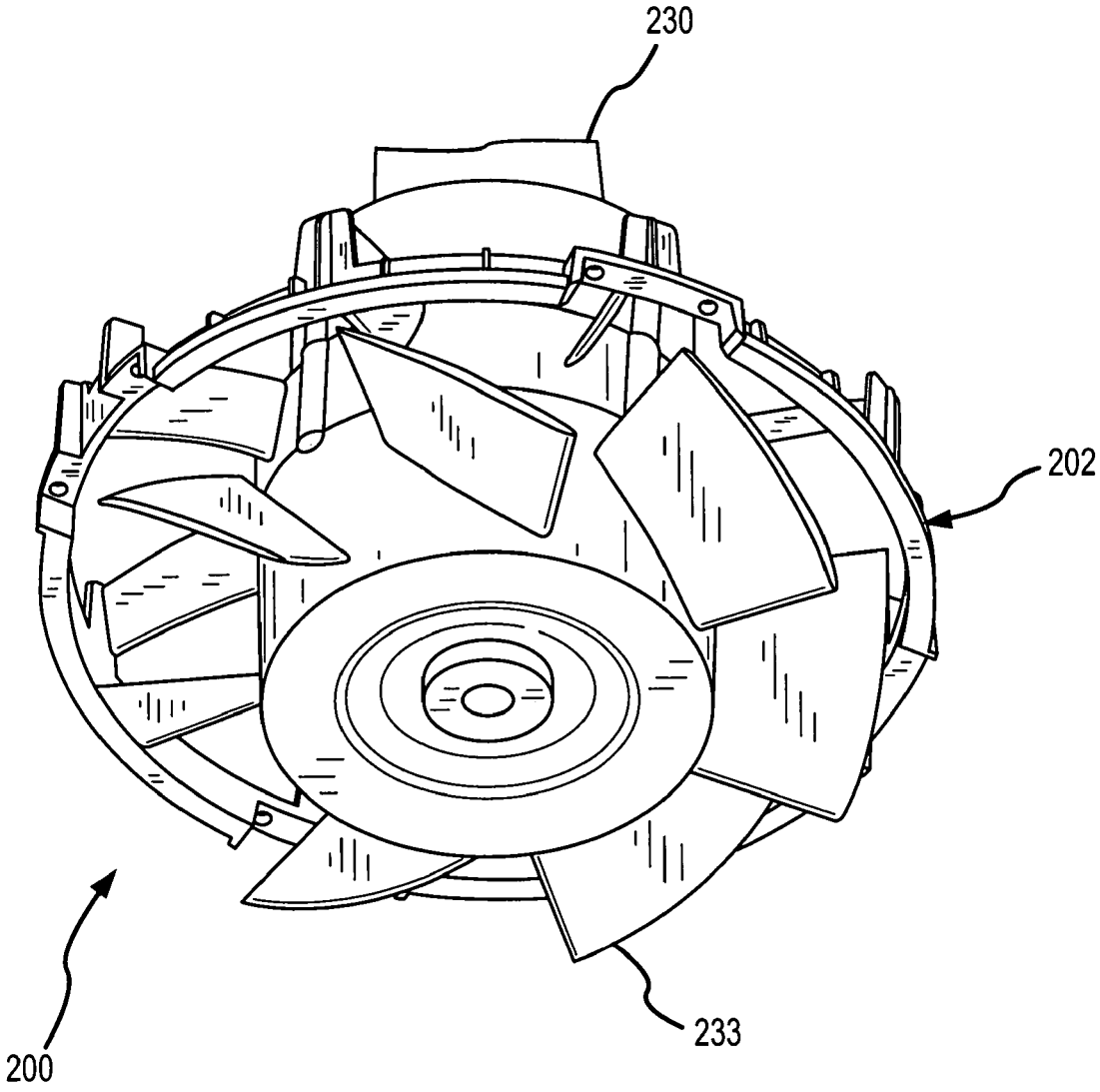
FIG. 4 shows the motor after addition of an impeller.

FIG. 4 shows the motor 230 after addition of an impeller 233. The impeller 233 generates an airflow that is substantially axially directed with respect to the motor 230.

Figure 5:
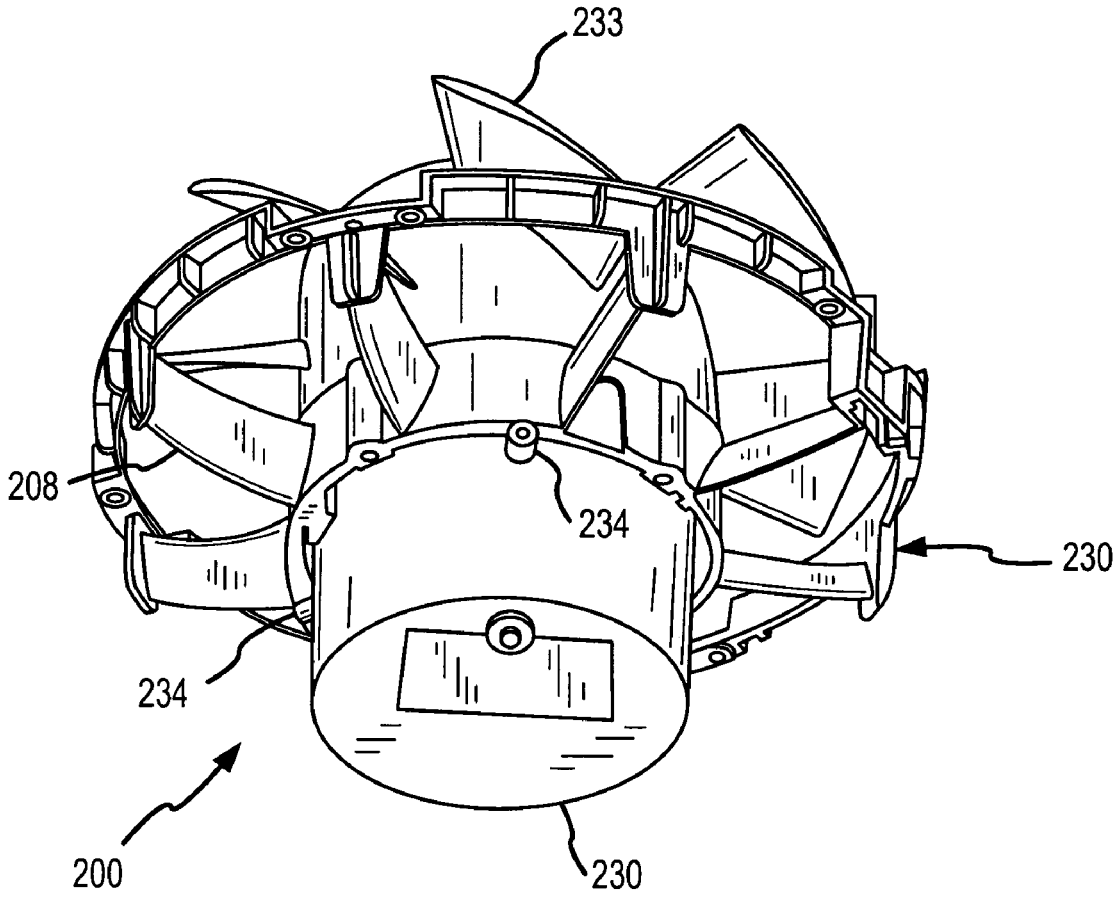
FIG. 5 shows the motor and the motor mount from a different angle.

FIG. 5 shows the motor 230 and the motor mount 202 from a different angle. It can be seen from this figure that the motor 230 can include the plurality of fastener bosses 234. In the embodiment shown, the motor 230 includes three fastener bosses 234 equidistantly spaced around a circumference of the motor 202. However, the motor 230 can include any number of fastener bosses 234. A fastener boss 234 includes a bore that receives a motor fastener. A fastener boss 234 in one embodiment includes a threaded bore.

Figure 6:
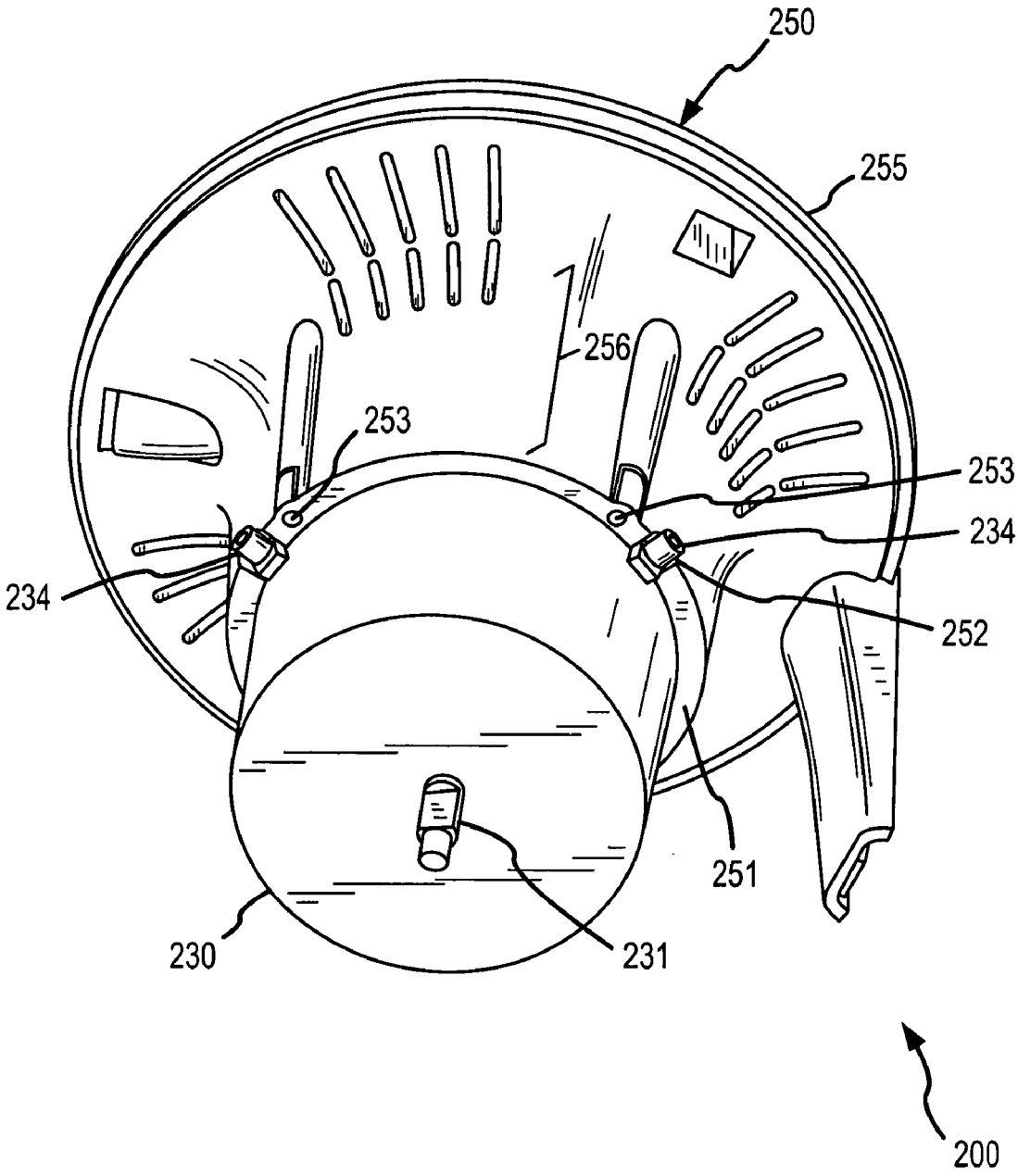
FIG. 6 shows the motor fitted to an airflow shaper according to an embodiment of the invention.

FIG. 6 shows the motor 230 fitted to an airflow shaper 250 according to an embodiment of the invention. The airflow shaper 250 in one embodiment comprises a base 255, a raised central region 256, and an end 251. The raised central region 256 in one embodiment includes a substantially cylindrical, hollow end 251. A plurality of shaper fastener apertures 253 are formed in the end 251. The shaper fastener apertures 253 correspond to the motor ring motor ring fastener apertures 215 of the motor mount 202. Therefore, the motor mount 202 can be affixed to the airflow shaper 250 through use of suitable motor ring fasteners.

The airflow shaper 250 fits over an end of the motor 230 opposite the motor shaft 231. Airflow generated by the motor 230 and impeller 233 impinges on the airflow shaper 250 and is redirected by the airflow shaper 250. The fastener bosses 234 of the motor 230 are received in corresponding cut-outs 252 in the airflow shaper 250. Motor fasteners can engage the fastener bosses 234 and can clamp one or both of the motor mount 202 and the airflow shaper 250 to the motor 230.

Figure 7:
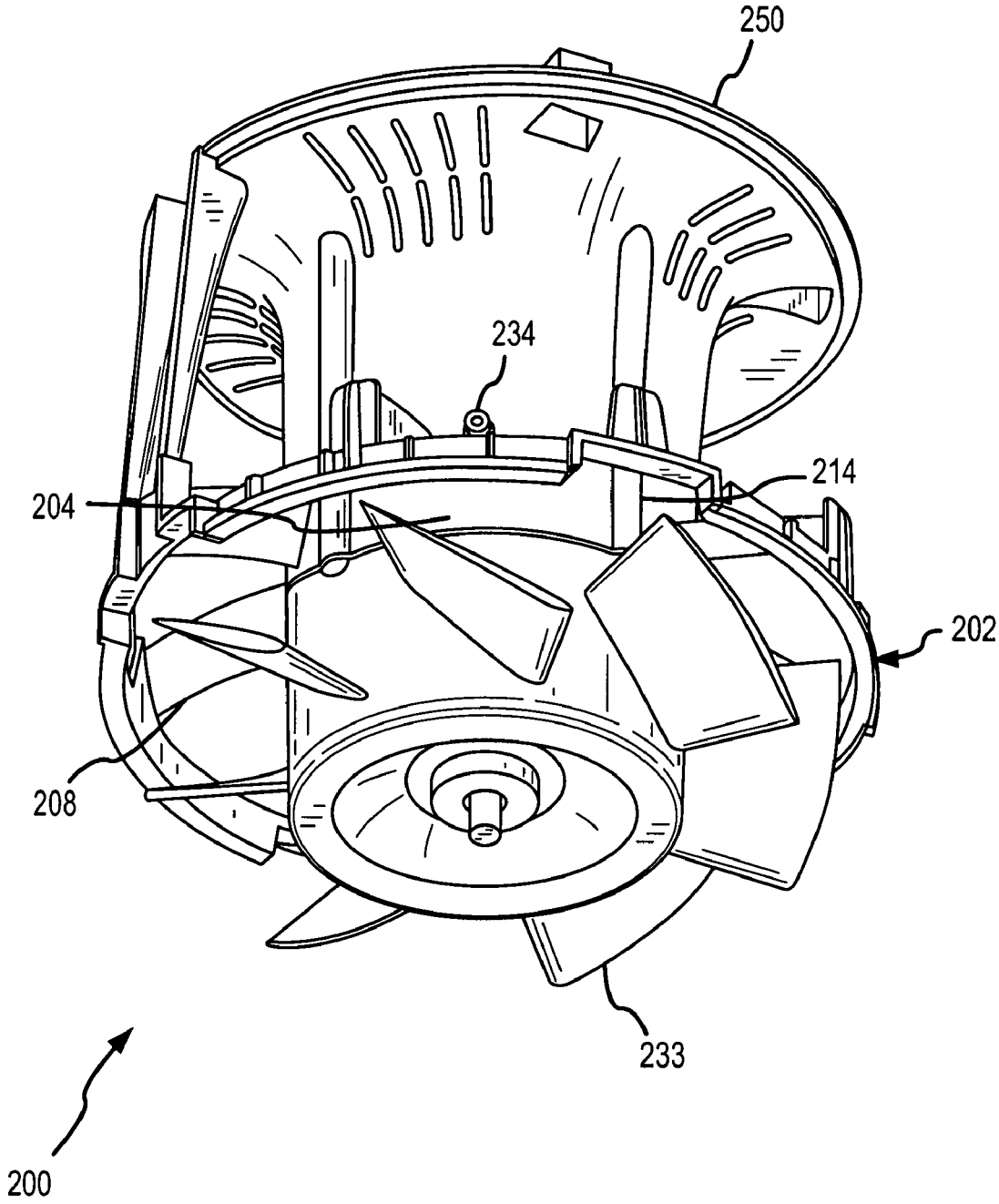
FIGS. 7-8 show the motor and the motor mount fully assembled to the airflow shaper according to an embodiment of the invention.
Figure 8:
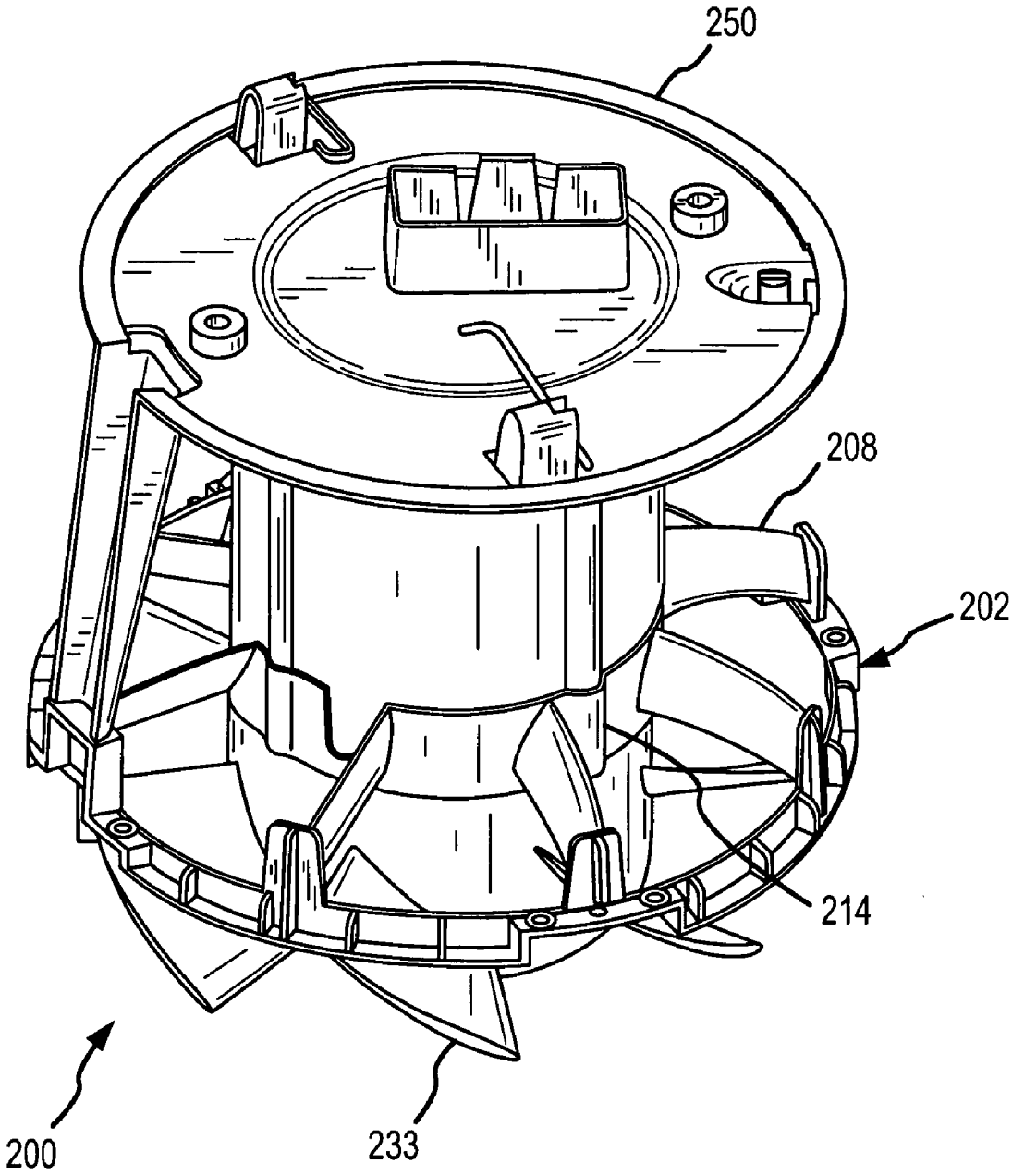

FIGS. 7-8 show the motor 230 and the motor mount 202 fully assembled to the airflow shaper 250 according to an embodiment of the invention. Consequently, the motor ring 204 is abutting the airflow shaper 250. The motor mount 202 and the airflow shaper 250 in combination can form the motor mount assembly 200. The fastener bosses 234 of the motor 230 are positioned in the cut-outs 252 of the airflow shaper 250. Corresponding motor fasteners (not shown) can be installed in the fastener bosses 234, wherein such motor ring fasteners can provide a clamping force onto one or both of the airflow shaper 250 and the motor ring 204 of the motor mount 202. In addition, motor ring fasteners can be installed in the fastener clearance troughs 214 and motor ring motor ring fastener apertures 215 of the motor ring 204. The motor ring fasteners can engage the shaper fastener apertures 253 of the airflow shaper 250. As a result, the motor mount 202 is affixed to the airflow shaper 250. Further, the motor 230 is held with respect to both the motor mount 202 and the airflow shaper 250.

The assembled motor 230 and motor mount assembly 200 generates an airflow that is substantially axially directed with respect to the motor 230. The resulting airflow impinges on the airflow shaper 250 and is redirected by the airflow shaper 250.

The airflow can pass through one or more filter elements (not shown). The one or more filter elements can remove dirt and debris from the airflow. The one or more filter elements can remove ozone from the airflow, if desired. The one or more filter elements can remove Volatile Organic Compounds (VOCs) from the airflow, if desired. The one or more filter elements can remove odors from the airflow, if desired. The one or more filter elements can treat the airflow to add fragrance or odor, if desired.

The motor mount assembly according the invention can be implemented according to any of the embodiments in order to obtain several advantages, if desired. The invention provides a motor mount assembly that provides a substantially rigid and strong mount for a fan motor of an air cleaner. The invention provides a motor mount assembly that includes a plurality of mounting vanes. The invention provides a motor mount assembly that comprises substantially aerodynamic mounting vanes. The invention provides a motor mount assembly that comprises mounting vanes that at least partially straighten the airflow. The invention provides a motor mount assembly that is easy to install and remove. The invention provides a motor mount assembly that presents a minimal resistance to airflow.

What is claimed is:

1. A motor mount assembly for an air cleaner, comprising:

a motor ring adapted for receiving a motor;

a mount ring adapted to be received in the air cleaner; and a plurality of mounting vanes extending between the motor ring and the mount ring, with a mounting vane of the plurality of mounting vanes comprising a proximal end and a distal end, with the distal end being affixed to the motor ring and with the proximal end being affixed to the mount ring.

2. The motor mount assembly of claim 1, with the motor ring holding the motor is substantially coaxially centered in the mount ring.

3. The motor mount assembly of claim 1, wherein a mounting vane of the plurality of mounting vanes is angled to be substantially in alignment with an airflow.

4. The motor mount assembly of claim 1, wherein a mounting vane of the plurality of mounting vanes includes a substantially aerodynamic cross-sectional shape.

5. The motor mount assembly of claim 1, wherein a mounting vane of the plurality of mounting vanes includes a substantially airfoil cross-sectional shape.

6. The motor mount assembly of claim 1, further comprising a plurality of projecting members disposed inside the motor ring.

7. The motor mount assembly of claim 1, further comprising an airflow shaper including a substantially cylindrical, hollow end, wherein the motor fits at least partially into the airflow shaper and the motor mount fits over the motor and affixes to the airflow shaper.

8. The motor mount assembly of claim 1, further comprising:

a plurality of fastener clearance troughs and corresponding motor ring fastener apertures formed motor ring; and an airflow shaper including a substantially cylindrical, hollow end and a plurality of shaper fastener apertures formed in the end and corresponding to the plurality of fastener clearance troughs and motor ring fastener apertures in the motor ring.

9. The motor mount assembly of claim 1, further comprising:

an airflow shaper including a substantially cylindrical, hollow end and a plurality of cut-outs formed in the end;

wherein the motor fits at least partially into the airflow shaper, the motor mount fits over the motor, and a plurality of corresponding fastener bosses on the motor are received in the plurality of cut-outs, and further wherein the plurality of fastener bosses are adapted to receive a plurality of motor fasteners that clamp one or both of the motor mount and the airflow shaper to the motor.

10. A motor mount assembly for an air cleaner, comprising:

an airflow shaper including a substantially cylindrical, hollow end and a plurality of cut-outs formed in the end; and a motor mount comprising:

a motor ring adapted for receiving a motor;

a mount ring adapted to be received in the air cleaner; and a plurality of mounting vanes extending between the motor ring and the mount ring, with a mounting vane of the plurality of mounting vanes comprising a proximal end and a distal end, with the distal end being affixed to the motor ring and with the proximal end being affixed to the mount ring.

11. The motor mount assembly of claim 10, with the motor ring holding the motor substantially coaxially centered in the mount ring.

12. The motor mount assembly of claim 10, wherein a mounting vane of the plurality of mounting vanes is angled to be substantially in alignment with an airflow.

13. The motor mount assembly of claim 10, wherein a mounting vane of the plurality of mounting vanes includes a substantially aerodynamic cross-sectional shape.

14. The motor mount assembly of claim 10, wherein a mounting vane of the plurality of mounting vanes includes a substantially airfoil cross-sectional shape.

15. The motor mount assembly of claim 10, further comprising a plurality of projecting members disposed inside the motor ring.

16. The motor mount assembly of claim 10, wherein the motor fits at least partially into the airflow shaper and the motor mount fits over the motor and affixes to the airflow shaper.

17. The motor mount assembly of claim 10, further comprising:

a plurality of fastener clearance troughs and corresponding motor ring fastener apertures formed in the motor ring; and a plurality of shaper fastener apertures formed in the airflow shaper corresponding to the plurality of fastener clearance troughs and motor ring fastener apertures in the motor ring.

18. The motor mount assembly of claim 10, wherein the motor fits at least partially into the airflow shaper, the motor mount fits over the motor, and a plurality of fastener bosses on the motor are received in the plurality of cut-outs, and further wherein the plurality of fastener bosses are adapted to receive a plurality of motor fasteners that clamp one or both of the motor mount and the airflow shaper to the motor.

19. A method of installing a motor in an air cleaner, comprising:

providing an airflow shaper including a substantially cylindrical, hollow end, a plurality of cut-outs formed in the end, and a plurality of shaper fastener apertures formed in the end;

inserting the motor into the airflow shaper and inserting a plurality of fastener bosses of the motor into the plurality of cut-outs of the airflow shaper;

sliding a motor mount over the motor and into contact with the airflow shaper, with the motor mount comprising a motor ring adapted for receiving a motor, a mount ring adapted to be received in the air cleaner, and a plurality of mounting vanes extending between the motor ring and the mount ring, with a mounting vane of the plurality of mounting vanes comprising a proximal end and a distal end, with the distal end being affixed to the motor ring and with the proximal end being affixed to the mount ring;

inserting a plurality of motor ring fasteners through a corresponding plurality of motor ring fastener apertures of the motor ring and into engagement with the plurality of shaper fastener apertures of the airflow shaper; and engaging a plurality of motor fasteners with the plurality of fastener bosses of the motor, wherein the plurality of motor fasteners clamp one or both of the motor mount and the airflow shaper to the motor.

20. The method of claim 19, with the motor ring holding the motor substantially coaxially centered in the mount ring.

21. The method of claim 19, wherein a mounting vane of the plurality of mounting vanes is angled to be substantially in alignment with an airflow.

22. The method of claim 19, wherein a mounting vane of the plurality of mounting vanes includes include a substantially aerodynamic cross-sectional shape.

23. The method of claim 19, wherein a mounting vane of the plurality of mounting vanes includes include a substantially airfoil cross-sectional shape.

24. The motor mount assembly of claim 1, with the mount ring affixed to a frame of the air cleaner.

25. The motor mount assembly of claim 1, with the mount ring further comprising an extension adapted to receive a mounting vane of the plurality of mounting vanes.

26. A motor mount assembly for an air cleaner, comprising:

a motor ring;

a mount ring comprising an extension; and a plurality of mounting vanes extending between the motor ring and the mount ring, with a mounting vane of the plurality of mounting vanes comprising a proximal end and a distal end, with the distal end being affixed to the motor ring and the proximal end being affixed to the mount ring;

wherein an end of a mounting vane of the plurality of mounting vanes is received by the extension.

27. The motor mount assembly of claim 26, with a mounting vane of the plurality of mounting vanes including a substantially airfoil cross-sectional shape.

28. The motor mount assembly of claim 26, with the mount ring being at a lower level than the motor ring.

29. The motor mount assembly of claim 26, with a mounting vane of the plurality of mounting vanes including an arch.

30. The motor mount assembly of claim 26, with a mounting vane of the plurality of mounting vanes including a cross-sectional shape having a rounded leading edge and a tapered trailing edge.

31. The motor mount assembly of claim 26, with the extension of the mount ring further comprising a rib.

* * * * *